US010815741B2

(12) United States Patent
Louie

(10) Patent No.: US 10,815,741 B2
(45) Date of Patent: Oct. 27, 2020

(54) GRIPPER SYSTEM FOR COILED TUBING INJECTOR

(71) Applicant: Greg H Louie, Calgary (CA)

(72) Inventor: Greg H Louie, Calgary (CA)

(73) Assignee: Greg H louie (CA)

( * ) Notice: Subject to any disclaimer, the term of this patent is extended or adjusted under 35 U.S.C. 154(b) by 0 days.

(21) Appl. No.: 16/030,906

(22) Filed: Jul. 10, 2018

(65) Prior Publication Data

US 2019/0017337 A1 Jan. 17, 2019

Related U.S. Application Data

(60) Provisional application No. 62/532,840, filed on Jul. 14, 2017.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 5,094,340 | A * | 3/1992 | Avakov | B65G 37/005 198/604 |
| 6,230,955 | B1 * | 5/2001 | Parks | B65G 37/005 166/77.3 |
| 7,857,042 | B2 * | 12/2010 | Koopmans | E21B 19/22 166/77.3 |
| 10,024,122 | B2 * | 7/2018 | Bujold | E21B 17/20 |
| 2012/0222855 | A1 * | 9/2012 | Chartier | E21B 19/22 166/77.3 |
| 2015/0361739 | A1 * | 12/2015 | Quirion | E21B 19/22 166/379 |

* cited by examiner

*Primary Examiner* — Matthew R Buck
(74) *Attorney, Agent, or Firm* — Greg H Louie

(57) ABSTRACT

The present disclosure provides an improved gripper system for accommodating tubing of different diameters of a coiled tubing injector.

10 Claims, 7 Drawing Sheets

GRIPPER SYSTEM FOR COILED TUBING INJECTOR

FIELD

The present invention relates to gripper system for coiled tubing injection equipment used in the oil and gas production industry. More specifically, the present invention relates to a gripper block combination designed to accommodate coiled tubing with different and/or varying outside diameters.

BACKGROUND

Coil tubing injectors have been used in oil wells for downhole, horizontal and/or slanted wells for remedial or production operations, such as circulating treating fluids, setting downhole tools, cleaning the internal walls of well pipes, conducting producing fluids or lift gas, etc.

Typically the coil tubing injectors utilize a pair of opposed endless drive chains which are arranged in a common plane. The drive chains are generally made up of links, rollers and gripper blocks. These drive chains are generally driven by sprockets powered by a motor, such as a reversible hydraulic motor. The opposed drive chains grip the coiled tubing between them. These drive chains are backed up so that a goodly number of pairs of opposed gripping blocks are in gripping engagement with the tubing at any given Moment. As the chains are in motion and the tubing is being driven, each time a pair of gripper blocks is actuated to release their hold on the tubing another pair is actuated to gripping position. The moving drive chains are thus able to force the tubing into the well, or to remove the same therefrom depending upon the direction in which they are driven.

Over the years, a variety of gripper blocks have been developed to improve the performance of coiled tubing injector units. Such improvements include designs directed to increasing the load carrying capability of gripper blocks, thus eliminating or limiting scarring and distortion of the tubing caused by gripper block engagement; reducing the weight of gripper blocks; reducing the manufacturing costs of gripper blocks.

Coil tubing operations requiring different sizes of tubing being run require changing gripper blocks, which increases safety hazards and require downtime in operations. Therefore attempts have been made in providing the ability to accommodate differing tubing diameters without having to change gripper blocks.

U.S. Pat. No. 5,094,340 and discloses use of two identical V-shaped gripper blocks each having a pair of flat gripping surface for accommodate differing coil tubing diameters. U.S. Pat. No. 6,892,810 discloses use of two identical gripper blocks, each comprising a block body being connectable to a gripper chain in an injector apparatus, a gripper plate having arcuate and/or angled gripping surfaces for engaging tubing of various outer diameters, and a flex layer disposed between the gripper plate and the block body to allow the gripping surface of the gripper plate to move relative to the block body to which it is attached.

Gripper block combination such as disclosed in U.S. Pat. Nos. 5,094,340 and 6,892,810 provide varying diameter accommodation within a limited range.

Accordingly, there is a need for an improved gripper block system/assembly which is capable of engaging the surfaces of coil tubing of different diameters, and can accommodate a wider range of outer diameters, while reducing stress on tubing.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

In accordance with the present invention there is provided a gripper system for use in association with continuous chains of a coiled tubing injector to move tubing of different sizes in a longitudinal direction. The system comprises a first gripper block comprising a pair of longitudinally oriented parallel side walls, wherein the inner surface of each side wall is a gripper surface, the gripper surfaces together forming a generally v-shaped major gripping channel, and a second gripper block comprising a pair of longitudinally oriented parallel side walls, wherein the inner surface of each side wall is a gripper surface, the gripper surfaces together form a generally v-shaped minor gripping channel. The side walls of the second gripper block are sized/configured to fit within the major gripping channel of the first gripper block.

The present invention is an improvement over the gripping blocks used in the known prior art and overcomes many of the shortcomings associated therewith. The present invention has established that utilizing different sized gripper blocks in the gripping system extends the useful size range with respect to the accommodation of different size coil tubing.

In addition, utilization of gripper blocks having the unique profile reduces high stress concentrations which extend the life of the equipment through the four distributed points of contact between the tubing and the gripper blocks, regardless of the size of the tubing in addition to increasing the range of sizes.

BRIEF DESCRIPTION OF THE DRAWINGS

The present disclosure will be better understood when read in connection with the following drawings.

FIG. 48 depicts the 4-point contact of a small diameter tubing within the gripping channels of a gripping system in accordance with one embodiment of the present invention.

DETAILED DESCRIPTION OF THE EMBODIMENTS

Figure 1:
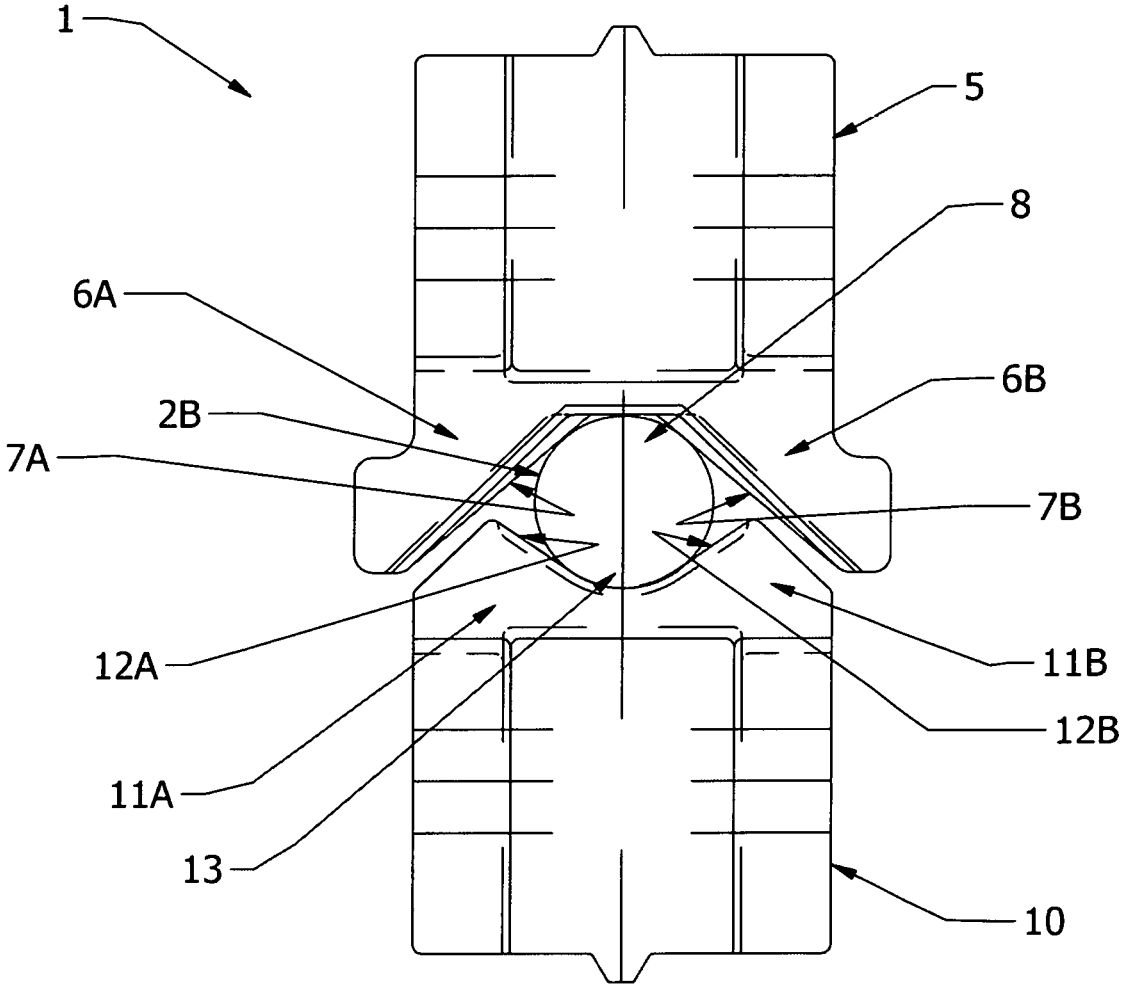
FIG. 1 illustrates an end view of the gripper system in accordance with at least one embodiment of the present invention, gripping a small diameter tubing.

The present disclosure provides an improved gripper system for use in association with continuous chains of a coiled tubing injector that can accommodate a wide range of tubing diameters. The gripper system of the present invention involves two gripper blocks of different size, wherein side walls of the smaller block are sized/configured to fit within the gripping channel of the larger gripper block.

In some embodiments, the gripper the system of the present invention comprises two gripper blocks, each comprising a pair of longitudinally oriented side walls. The inner surface of each side wall forms a gripper surface. The gripper surfaces of each bock together form a generally v-shaped channel. The gripper blocks are sized such that one of the gripper block form a major/bigger v-shaped channel, and the other one forms a minor V-shaped channel. The side walls of the smaller gripper block are sized/configured to fit within the major gripping channel of the bigger gripper block.

The term "generally v-shaped" as used in context of the present invention includes two converging side walls meeting at a point or having a substantially arcuate or substantially flat base.

The gripper surfaces of the major and/or minor gripping channels form an angle of between about 90 degrees to about 120 degrees. In some embodiments, the angle of the major gripping channel is about 90 degrees. In some embodiments, the angle of the minor gripping channel is about 90 degrees.

In some embodiments, the gripper surfaces of the first and/or second gripper blocks comprise grooves to enhance gripping of the contacting surfaces. In preferred embodiments, the grooves are transversely oriented.

The gripper blocks of the present invention can be configured for direct attachment to a respective continuous chain of the coiled tubing injector or can be attached through a carrier gripper.

In some embodiments, each of the first and second gripper blocks is configured for direct attachment to a respective continuous chain of the coiled tubing injector. In some embodiments, each of the first and second gripper blocks is configured for attachment to a respective continuous chain of the coiled tubing injector via an intermediate gripper carrier.

In some embodiments, the first gripper block is configured for attachment to one of the continuous chain of the coiled tubing injector via an intermediate gripper carrier, and the second gripper block is configured for direct attachment to the other of the continuous chain of the coiled tubing injector.

In some embodiments, gripper blocks when configured to be attached directly to the coil tubing can have a configuration known in the art, for example, as disclosed in U.S. Pat. No. 5,094,340.

In some embodiments, the gripper blocks of the present invention are configured for attachment via carriers known in the art, for example, as disclosed in U.S. Pat. No. 6,892,810.

In some embodiments, the first and second gripper blocks are each a unitary body formed from cast, forged or machined metal. In some embodiments, the metal is steel, titanium, case hardened steel, chromium-molybdenum steel or a suitable metal alloy.

Figure 2:
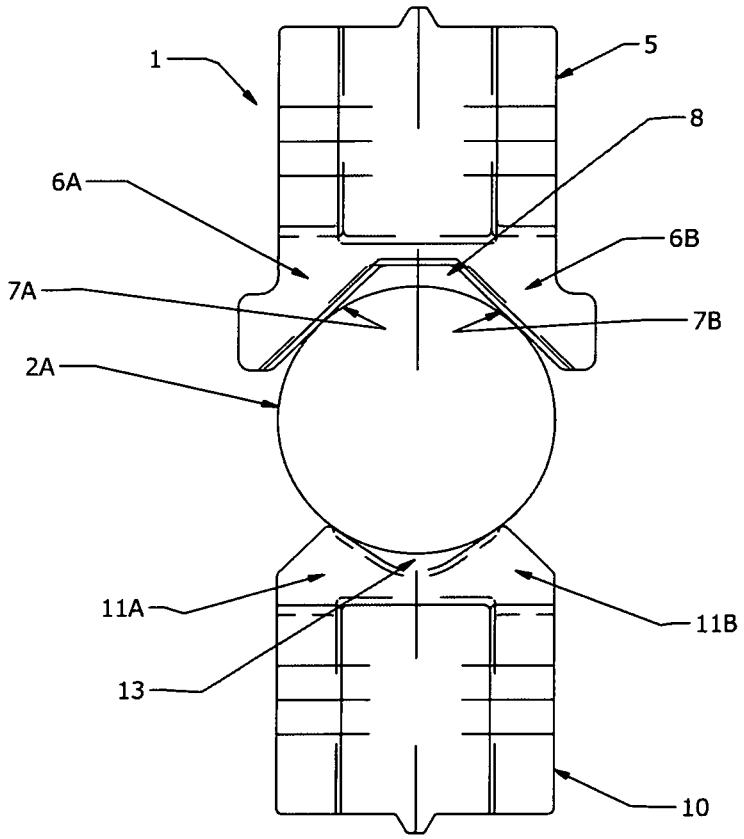
FIG. 2 illustrates an end view of the gripper system in accordance with the embodiment of FIG. 1, gripping a large diameter tubing.

FIGS. 1 and 2 depict a gripper system in accordance with the present invention. Gripper system 1 comprises first gripper block 5 comprising a pair of longitudinally oriented parallel side walls. 6A,6B. Gripper surfaces 7A,7B are formed on the inner surface of each side wall, and together form generally v-shaped major gripping channel 8 on first gripper block 5. Gripper system 1 also comprises second gripper block 10 comprising a pair of longitudinally oriented parallel side walls 11A,11B. Gripper surfaces 12A,12B are formed on the inner surface of each side wall, and together form generally v-shaped minor gripping channel 13 on second gripper block 5.

The gripper system is configured to accommodate the tubing within the gripping channels of the first and second gripping blocks.

FIG. 1 depicts the gripper system 1 gripping a small diameter tubing 2B. As shown in FIG. 1, the side walls of the second gripper block 5 are sized/configured to fit within the major gripping channel 8 of the first gripper block 5 to ensure a tight grip on small diameter tubing within both minor gripping channel 13 and major gripping channel 8.

FIG. 2 depicts the gripper system 1 gripping a large diameter tubing 2A. As shown in FIG. 2, the tubing contacts both the major gripping channel 8 of the first gripper block 5 and the minor gripping channel 13 of the second gripper block 10 to ensure a tight grip on large diameter tubing.

Figure 3:
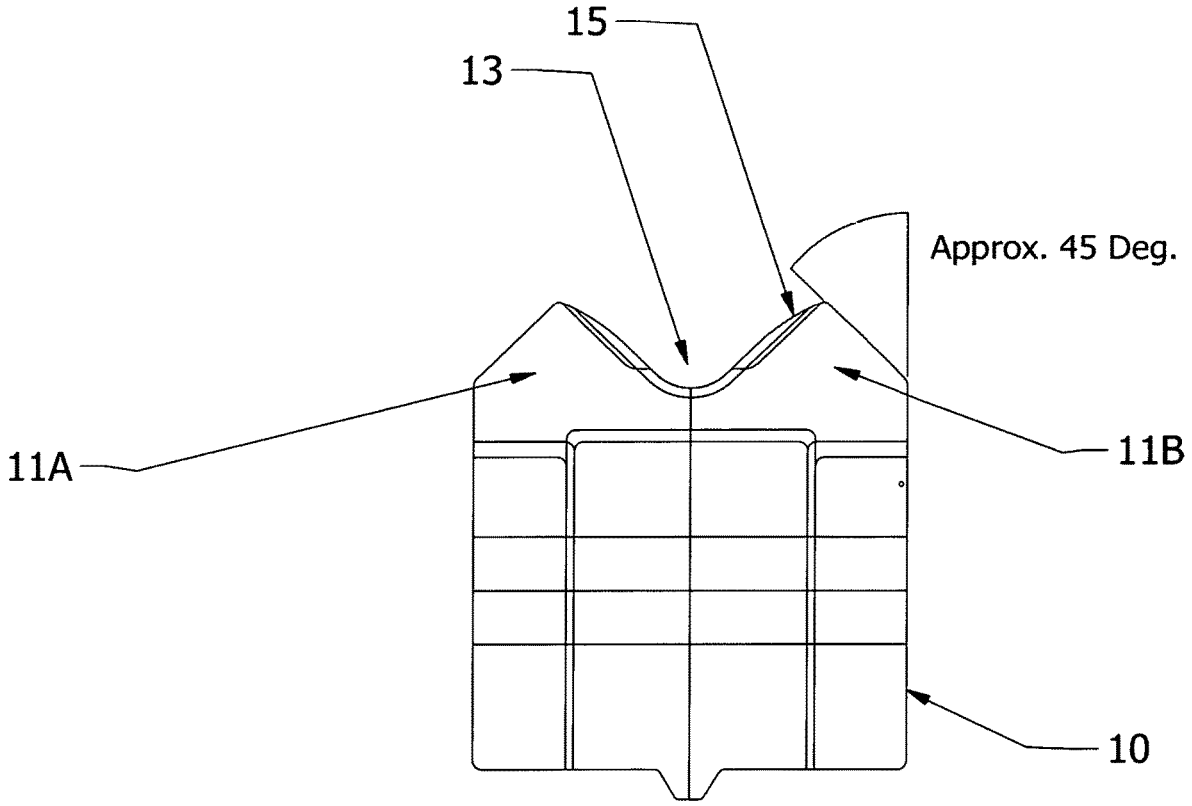
FIG. 3 illustrates a detail of the minor gripping channel of a gripper block in accordance with one embodiment of the present invention.

FIG. 3 depicts a detail of the first gripper block 10, showing grooves 15 on the gripper surfaces of the minor gripping channel.

Figure 4A:
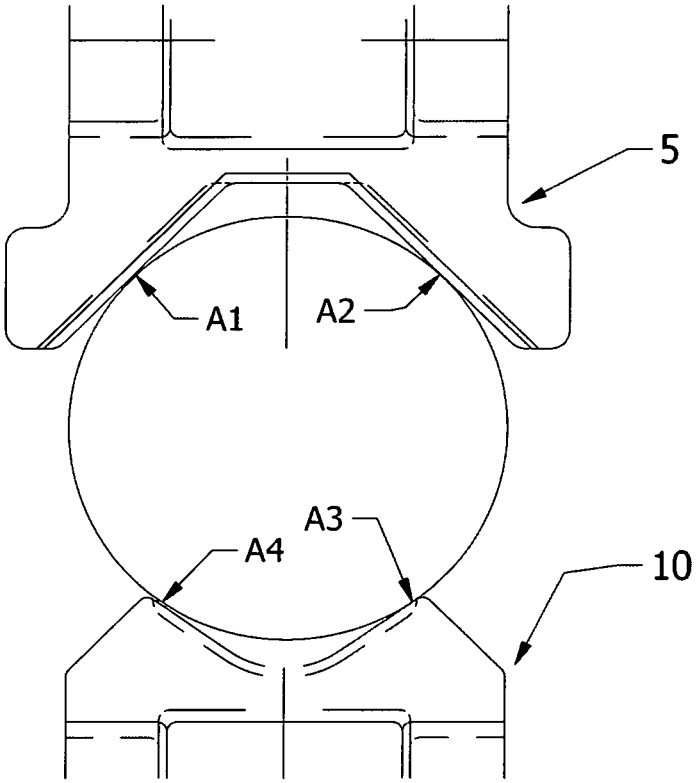
FIG. 4A depicts the 4-point contact of a large diameter tubing within the gripping channels of a gripping system in accordance with one embodiment of the present invention.

FIG. 4A depicts the four points of contact A1-A4 of a large diameter tubing within the major and minor gripping channels of the gripping system.

Figure 4B:
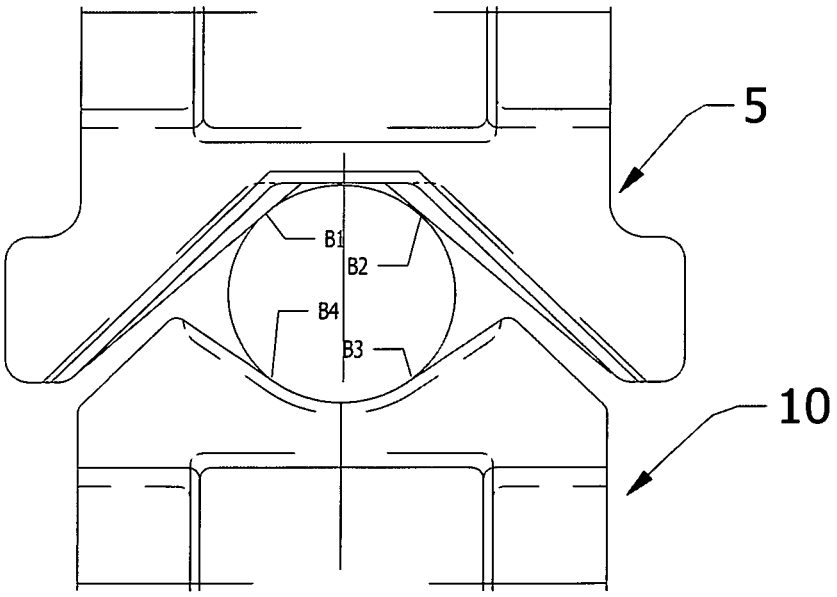

FIG. 4B depicts the four points of contact B1-B4 of a small diameter tubing within the major and minor gripping channels of the gripping system.

Figure 5:
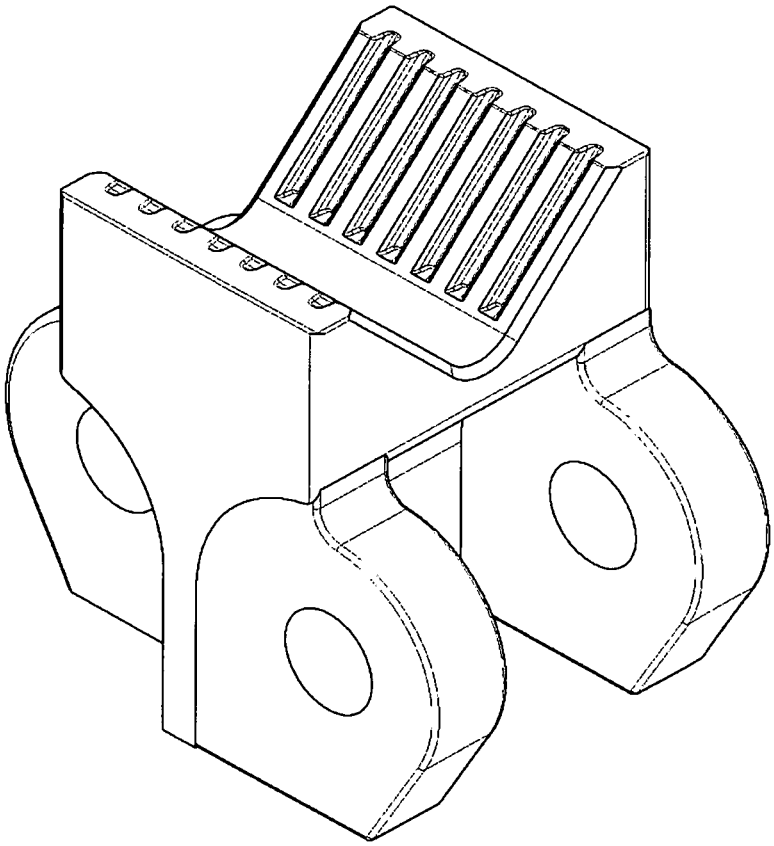
FIG. 5 depicts a perspective view of the first (larger) gripper block of a gripping system in accordance with one embodiment of the present invention.
Figure 6:
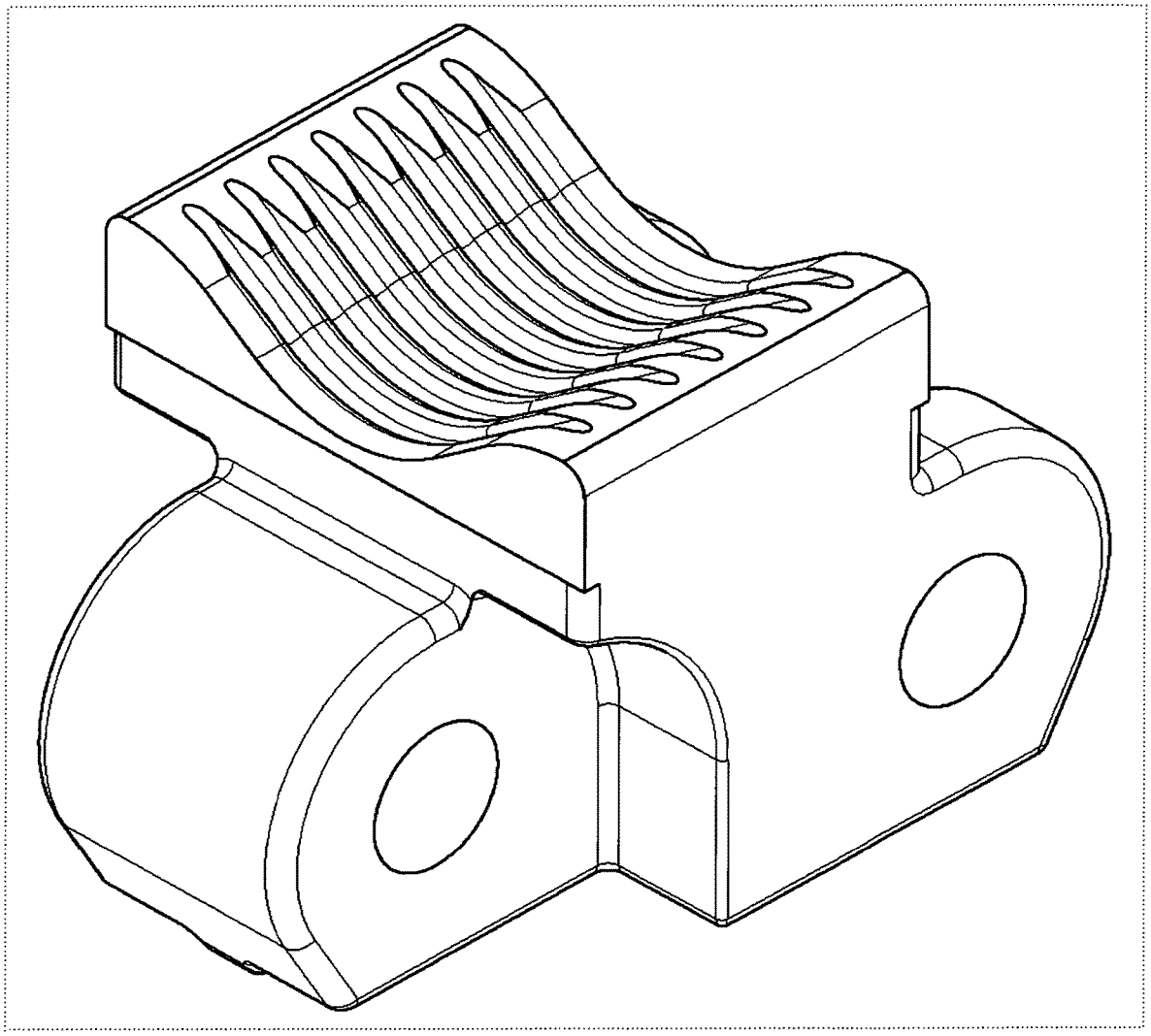
FIG. 6 depicts a perspective view of the second (smaller) gripper block of a gripping system in accordance with one embodiment of the present invention.
Figure 7:
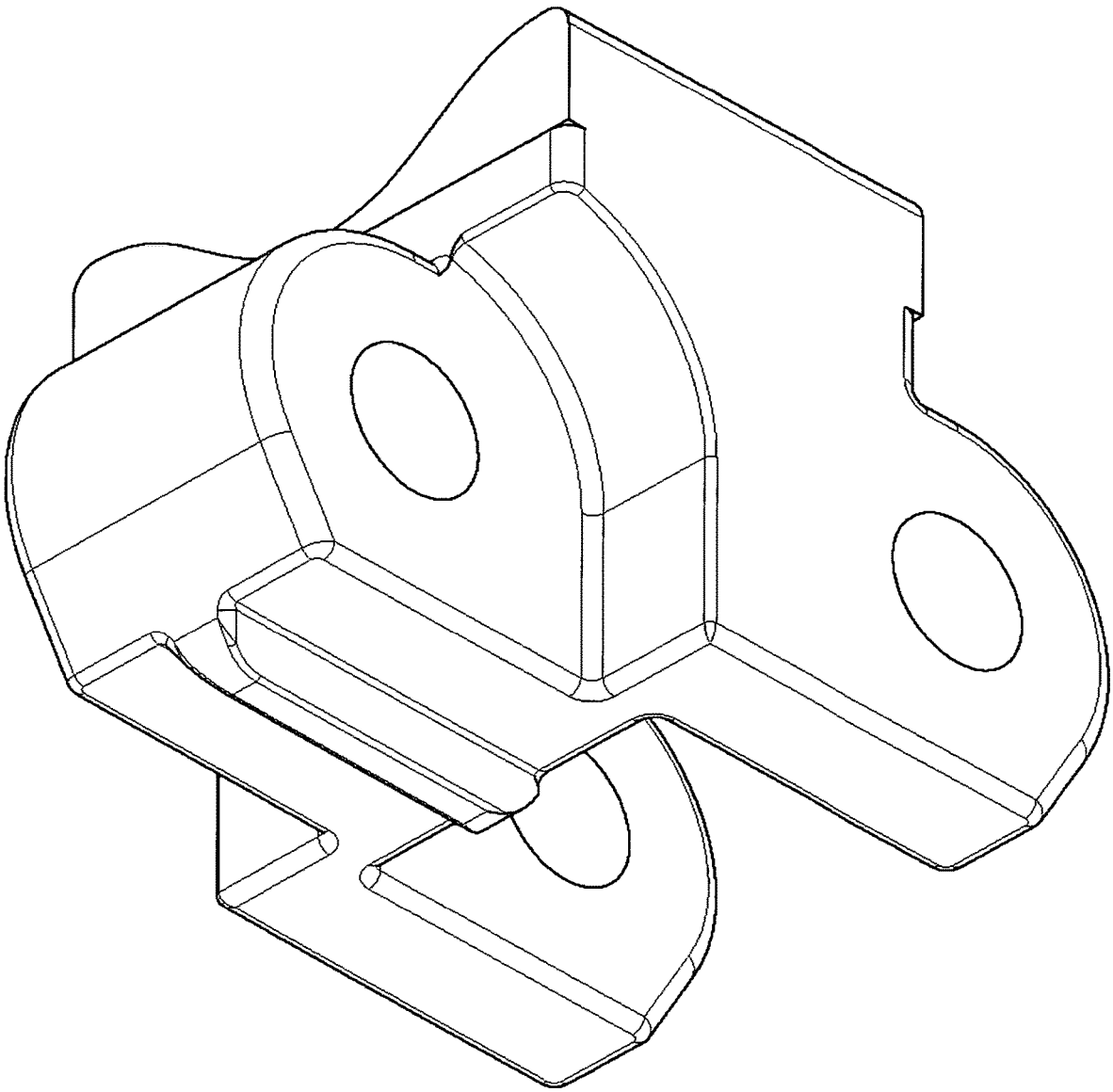
FIG. 7 depicts another perspective view of the second (smaller) gripper block of a gripping system in accordance with one embodiment of the present invention.

FIG. 5 depicts a perspective view of the first (larger) gripper block of the gripping system, along with a connection mechanism for continuous chain of the coiled tubing injector. In this embodiment, the gripper surface of each side wall is at an angle (about 90 degrees to about 120 degrees. FIGS. 6 and 7 depict perspective views of the second (smaller) gripper block of the gripping system, which is sized and configured by providing inner and outer surfaces of the sides walls at a specific angle relative to the sided walls of the major block.

As shown in FIG. 7, the side walls of the smaller block are also provided with a beveled surface between the outer and the inner surfaces.

All components discussed herein can be formed of any suitable material that will be readily understood by the skilled person, including steel, case hardened steel, chromium-molybdenum steel, among other suitable materials.

It is also contemplated that all components of the device need not necessarily be produced from the same materials, different components may be made from different materials depending on needs and performance requirements of the components such as, but not limited to, strength, weight, etc.

All components discussed herein can be manufactured by any known suitable method including casting, milling and welding, among other suitable manufacturing techniques that will be readily understood by the skilled person. It is contemplated that the gripper shoe and the gripper carrier can each be formed of a single unitary component or separate components suitably connected by mechanical connectors or welding, or other suitable connection methods.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. A gripper system for use in association with continuous chains of a coiled tubing injector to move tubing of different sizes in a longitudinal direction, the system comprising:

a first gripper block comprising a pair of longitudinally oriented side walls, wherein an inner surface of each side wall is a gripper surface, the gripper surfaces together forming a generally v-shaped major gripping channel; and an opposing second gripper block of different size relative to the first gripper block, comprising a pair of longitudinally oriented side walls, wherein an inner surface of each side wall is a gripper surface, the gripper surfaces together forming a generally v-shaped minor gripping channel;

the first gripper block configured to attach to a first one of the continuous chains of the coiled tubing injector, and the second gripper block, configured to attach to a second of the continuous chains of the coiled tubing injector opposing the first gripper block, wherein the side walls of the second gripper block are configured to fit within the major gripping channel of the first gripper block providing a complimentary fit thereby expanding the range of tubing sizes configured to be moved by the gripper system.

2. The system of claim 1, wherein the gripper surfaces of the first and second gripper blocks comprise transversely oriented grooves.

3. The system of claim 1 or 2, wherein the gripper surfaces of the major gripping channel form an angle of between about 90 degrees to about 120 degrees.

4. The system of claim 3, wherein the angle of the major gripping channel is about 90 degrees.

5. The system of claim 1, wherein the gripper surfaces of the minor gripping channel form an angle of between about 90 degrees to about 120 degrees.

6. The system of claim 5, wherein the angle of the minor gripping channel is about 90 degrees.

7. The system of claim 1, wherein each of the first and second gripper blocks is configured for direct attachment to the first and second continuous chains of the coiled tubing injector respectively.

8. The system of claim 1, wherein each of the first and second gripper blocks is configured for attachment to the first and second continuous chains of the coiled tubing injector respectively via an intermediate gripper carrier.

9. The system of claim 1, wherein the first gripper block is configured for attachment to the first continuous chain of the coiled tubing injector via an intermediate gripper carrier, and wherein the second gripper block is configured for direct attachment to the second continuous chain of the coiled tubing injector.

10. The system of claim 1, wherein each of the first and second gripper blocks is a unitary body formed from cast, forged or machined metal.

* * * * *